US009517975B2

(12) United States Patent
Abisdid et al.

(10) Patent No.: US 9,517,975 B2
(45) Date of Patent: Dec. 13, 2016

(54) SELF-LIGHTING DEVICE FOR A CIGARETTE

(75) Inventors: Marlène Abisdid, Marseilles (FR); Charli Abisdid, Marseilles (FR); Dominique Medus, L'union (FR); Pierre Thebault, Ramonville-saint-agne (FR)

(73) Assignee: ETIENNE LACROIX TOUS ARTIFICES (SA), Muret (FR)

( * ) Notice: Subject to any disclaimer, the term of this patent is extended or adjusted under 35 U.S.C. 154(b) by 327 days.

(21) Appl. No.: 14/005,564

(22) PCT Filed: Mar. 14, 2012

(86) PCT No.: PCT/FR2012/050535

§ 371 (c)(1),
(2), (4) Date: Dec. 15, 2013

(87) PCT Pub. No.: WO2012/123679

PCT Pub. Date: Sep. 20, 2012

(65) Prior Publication Data

US 2014/0113239 A1 Apr. 24, 2014

(30) Foreign Application Priority Data

Mar. 17, 2011 (FR) ..... 11 52206

(51) Int. Cl.
*C06C 9/00* (2006.01)
*A24D 1/08* (2006.01)
(Continued)

(52) U.S. Cl.
CPC . *C06C 9/00* (2013.01); *A24D 1/08* (2013.01); *F23Q 2/02* (2013.01); *F24J 1/00* (2013.01)

(58) Field of Classification Search
CPC ..... C06C 9/00; A24D 1/08; F24J 1/00; F23Q 2/02; F23B 20/00
(Continued)

(56) References Cited

U.S. PATENT DOCUMENTS 2,029,186 A 1/1936 Peterson
3,109,435 A * 11/1963 Paley ..... A24D 1/08 131/329
8,663,188 B2 * 3/2014 Genosar ..... A61J 1/1406 222/95

FOREIGN PATENT DOCUMENTS

BE 407714 3/1935
BE 1012826 4/2001
(Continued)

OTHER PUBLICATIONS

International Search Report, Jun. 28, 2012, from International Phase of the instant application.
(Continued)

*Primary Examiner* — Alfred Basichas
(74) *Attorney, Agent, or Firm* — Pearl Cohen Zedek Latzer Baratz LLP

(57) ABSTRACT

The invention relates to a self-lighting device for a cigarette, comprising a primary chemical material (7) to be placed at the lighting end (4) of the cigarette (1); and a secondary chemical material (8) that is incompatible with the primary material (7), said primary and secondary materials being inflammable when they come into contact with each other. The device is characterized in that the secondary material (8) is arranged in a receptacle (9) designed to fit over the lighting end (4) of the cigarette (1), bringing the secondary material into contact with the primary material (7).

7 Claims, 4 Drawing Sheets

(51) Int. Cl.
*F23Q 2/02* (2006.01)
*F24J 1/00* (2006.01)

(58) Field of Classification Search
USPC ..... 431/267
See application file for complete search history.

(56) References Cited

FOREIGN PATENT DOCUMENTS

| | | | |
|---|---|---|---|
| BE | 1 015 826 | A5 | 9/2005 |
| BG | 97941 | | 1/1995 |
| DE | 3509293 | | 10/1986 |
| EP | 0066021 | | 12/1982 |
| EP | 0 171 601 | A1 | 2/1986 |
| EP | 0171601 | | 2/1986 |
| FR | 709175 | | 8/1931 |
| FR | 1 014 899 | A | 8/1952 |
| FR | 1014899 | | 8/1952 |
| FR | 7539535 | | 10/1977 |
| FR | 2905231 | | 3/2008 |
| GB | 314145 | | 6/1929 |
| GB | 356861 | | 9/1931 |
| GB | 406153 | | 2/1934 |
| GB | 752365 | | 7/1956 |
| GB | 790341 | | 2/1958 |
| JP | 20055224232 | | 2/2004 |

OTHER PUBLICATIONS

English Translation of the Written Opinion of the International Search Authority, Sep. 17, 2013, from International Phase of the instant application.

English Translation of International Preliminary Report on Patentability Chapter I, Sep. 17, 2013, from International Phase of the instant application.

* cited by examiner

SELF-LIGHTING DEVICE FOR A CIGARETTE

CROSS-REFERENCE TO RELATED APPLICATIONS

This application is a National Phase Application of PCT International Application No. PCT/FR2012/050535, International Filing Date Mar. 14, 2012, entitled "SELF-LIGHTING DEVICE FOR A CIGARETTE", published on Sep. 20, 2012 as International Publication No. WO 2012/123679, which in turn claims priority from French Patent Application No. 1152206, filed Mar. 17, 2011, all of which are incorporated herein by reference.

TECHNICAL FIELD OF THE INVENTION

The invention relates to a self-lighting device for a cigarette.

It relates to the technical field of pyrotechnical devices and more particularly those intended for lighting cigarettes and supplying an alternative to the conventional means of the lighter or match type.

PRIOR ART

Devices for self-lighting cigarettes illustrating prior art are described in the following patent documents: FR 2 905 231 (Charli ABISDID), BE 407 714 (M. MARGOLIS), DE 3 509 293 (LIECHTENSTEIN RICHARD VON), EP 0 066 021 (YOO, BYUNG EON) FR 7 539 535 (TOKYO ENGINEERING CO.) D5: GB 314 145 (Piedad and Alejandro LIFCHUZ), FR 709 175 (Giulio TURRI), JP 2005 5 224 232 (ISHIKAWA JOJI), GB 406 153 (Ansley HERMAN FOX). These devices comprise an ignition material configured to ignite a flammable material under the effect of an impact or friction. The friction strips generally used, are worn as the cigarettes are lit. And the more the strip is worn, the more difficult it is to light a cigarette.

In order to overcome this disadvantage, it is known through documents FR 1 014 899 (Louis Thomas FONDO), BE 1015826 (Pierre JACQUET), BG 97 941 (BONCHEV MIROSLAV B.), GB 356 861 (Robert SUTHERLAND), GB 752 365 (Hans HANNO MOSER), GB 790 341 (Kurt KORBER), devices for self-lighting comprising a primary chemical material placed at the end to be lit of the cigarette, and a secondary chemical material that is incompatible with the primary material. These devices use the principle of incompatibility of chemical materials that ignite spontaneously when they are brought into contact with each other. In practice, the secondary chemical material is:

- either conditioned on one of the faces of the cigarette pack in such a way that during the manipulation of said pack, said secondary chemical material can be detached, causing, because of this, difficulties to light cigarettes later,
- or conditioned in individual containers that are poorly adapted.

It is known more particularly through documents U.S. Pat. No. 2,029,186 (PETERSON), or U.S. Pat. No. 3,109,435 (PALEY), a cigarette provided with a self-lighting device comprising: a primary chemical material placed at the end to be lit of the cigarette, and a secondary chemical material that is incompatible with said primary material. The secondary material is contained in a removable receptacle configured in such a way as to be positioned against the end to be lit, in an arrangement enabling said secondary material to be brought into contact with the primary material. The secondary material is arranged on a pad left in the open air. The properties of the secondary material therefore are degraded rapidly with the passing of time.

In document EP 0 171 601 (ESPARZA), the chemical material is contained in capsules designed to be broken. A grid forms the bottom of the fastening zone of the receptacle. This grid is not sealed in such a way that the properties of the chemical material are degraded with the passing of time.

Faced with these conditions, the invention has for main objective to provide a device allowing for an easy lighting of a cigarette, while still suppressing the deficiencies linked to the conditioning of the secondary chemical material known in prior art.

The invention also has for purpose to provide a device for self-lighting that is easy to use, of simple design and inexpensive.

DIVULGATION OF THE INVENTION

The solution proposed by the invention is a self-lighting device for a cigarette comprising:

- a secondary chemical material that is incompatible with the primary material, said primary and secondary materials being capable of igniting when they are brought into contact with each other, said secondary material being arranged in a receptacle configured to fit over the end to be lit of the cigarette and to bring said secondary material into contact with said primary material, said receptacle being closed at one of its ends,
- the receptacle comprises a fastening zone having the shape of a cylindrical portion configured to fit onto the end to be lit of a cigarette.

This device is remarkable in that a seal forms the bottom of the fastening zone, the secondary material being arranged between said seal and the closed end of the receptacle, said seal being provided with a cannula directed towards said fastening zone, and configured so that said secondary material can flow outside of said cannula when a pressure is exerted on said receptacle.

Using such a unitary receptacle allows the user to systematically have a sufficient dose of secondary material available, providing the user with an effective lighting of cigarettes. Furthermore the design of such a receptacle can be carried out easily at the industrial stage and using it is attractive for users. Finally, the use of a cannula to delivery the secondary material is particularly advantageous:

- the secondary material is not in contact with the air, which allows it to keep intact all of its properties for a long time,
- the secondary material can be injected with precision and in depth in the end to be lit of the cigarette.

Other remarkable characteristics of the method of the invention are listed hereinbelow, with each of these characteristics able to be considered alone or in combination, independent of the characteristics defined hereinabove:

- the receptacle advantageously has the shape of a cylindrical tube of which the outer diameter corresponds substantially to that of a cigarette,
- the receptacle can comprise a fastening zone having the shape of a cylindrical portion configured to fit over the end to be lit of a cigarette,
- a frangible seal can form the bottom of the fastening zone, with the secondary material being arranged between said seal and the closed end of said receptacle,
- a seal forms the bottom of the fastening zone, with the secondary material being arranged between said seal and the closed end of the receptacle, a point being arranged inside said receptacle, on said bottom wall, said point being directed towards said fastening zone, a seal forms the bottom of the fastening zone, with the secondary material being arranged between said seal and the closed end of the receptacle, said seal being provided with a cannula directed towards said fastening zone, and configured so that said secondary material can flow outside of said cannula when a pressure is exerted on said receptacle, a seal forms the bottom of the fastening zone, with the secondary material being arranged between said seal and the closed end of the receptacle, said seal being mounted slidingly in said receptacle made of rigid material, said seal being furthermore provided with a cannula directed towards said fastening zone, and configured so that said secondary material can flow outside of said cannula when said seal slides in a direction that empties said receptacle, the secondary chemical material can be conditioned in one or several capsules arranged in the receptacle, said receptacle comprising one or several flexible walls making it possible to break said capsules by crushing when a force of pressure is exerted on said flexible wall or walls, preferably, the primary chemical material comprises potassium permanganate and the secondary chemical material comprises glycerin, the secondary material can have a solid, gel or cream form, said material being directly introduced into the receptacle, the secondary material can also have a fluid form, a spongy material being inserted in the receptacle, in such a way as to contain said secondary material, a simple pressure on said spongy material making it possible to release said secondary material.

DESCRIPTION OF THE FIGURES

Other advantages and characteristics of the invention shall appear better when reading the following description of a preferred embodiment, in reference to the annexed drawings, carried out by way of non-restricted examples for the purpose of information and wherein.

EMBODIMENTS OF THE INVENTION

Figure 1:
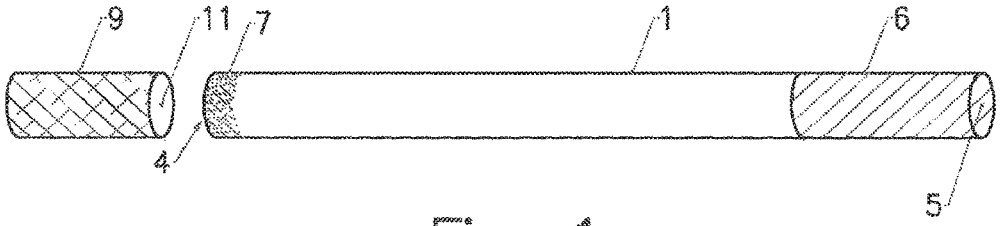
FIGS. 1 to 4 diagrammatically show the various steps making it possible to light a cigarette by means of a self-lighting device in accordance with the invention.

The invention makes it possible to self-light a cigarette 1. "Cigarette" means a conventional cigarette with or without a filter, a cigarillo, a cigar, or other similar object that can be consumed by a smoker. As shown diagrammatically in FIGS. 1 to 4, a cigarette 1 generally has the shape of a cylinder formed from a sheet of paper 2 and inside of which are arranged chopped leaves of tobacco 3. It has a diameter that can vary from 3 mm to 7 mm and a length that can vary from 60 mm to 100 mm. It comprises a end to be lit 4 and an inhalation end 5 opposite said end to be lit. The inhalation end 5 can in particular comprise a filter 6.

The self-lighting device of the invention comprises a primary chemical material 7 (or material "to be lit") intended to be placed at the end to be lit 4 of the cigarette 1. The primary chemical material 7 can be put into place via impregnation, coating, compression, insertion into the leaves of tobacco 3, of a liquid, gel, solid, powder, microcapsules, crystals, granules, etc. In practice, the primary material 7 is present over a depth of a few millimeters from the end to be lit 4. The setting in place of the primary material 7 is preferably carried out when the cigarette 1 is manufactured.

The tobacco can be impregnated beforehand with gum arabic in order to render the tobacco fibres sticky, before they are mixed with the primary material 7 having a solid, powder, microcapsules, crystals, granules, etc. form.

According to the shape chosen, a drying of the primary material 7 can be provided in order to ensure the compatibility of the technology before a storing of the cigarette 1 in a pack over a long duration. Indeed, a material that is not dry would risk polluting the pack, could cause the sticking of the cigarettes together, could soil fingers, the clothing of the user or objects (such as tables or ashtrays) whereon the cigarette 1 would be placed, etc.

Also, using a liquid primary material 7 that is encapsulated beforehand makes it possible to protect said primary material from being accidentally spilled, while still allowing the user to break this encapsulation via a suitable voluntary action (for example, by crushing by pressing the end of the cigarette 1 between two fingers). The technique of encapsulation can also be considered with a solid primary material 7.

Figure 6A:
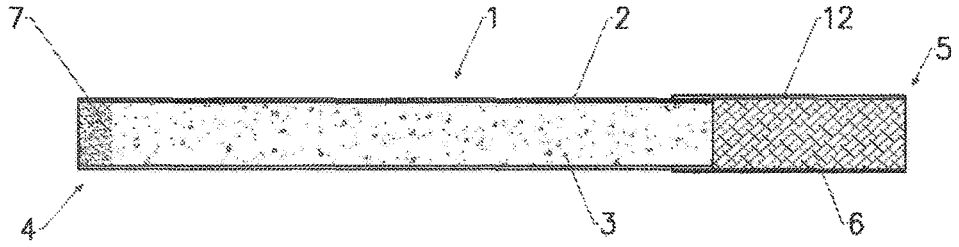

In reference to FIG. 6*a*, the primary material 7 is arranged directly at the end to be lit 4, for example using a spray. The end 4 can then be covered with a water-repellent varnish in order to prevent the penetration of water molecules into the cigarette 1.

Figure 6B:
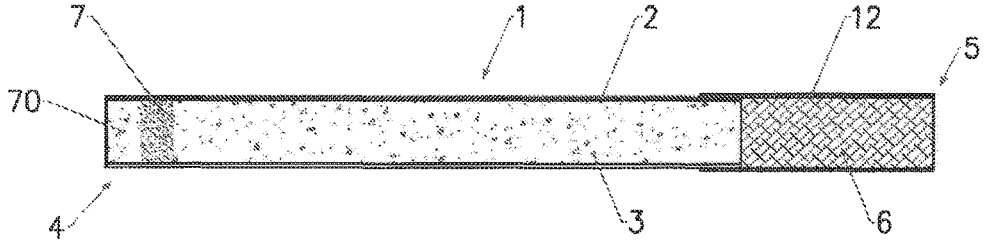

In the example of FIG. 6*b*, a "pad" of tobacco impregnated with primary material 7 is arranged at the end to be lit 4 then covered with a "pad" of non-treated tobacco 70.

Figure 6C:
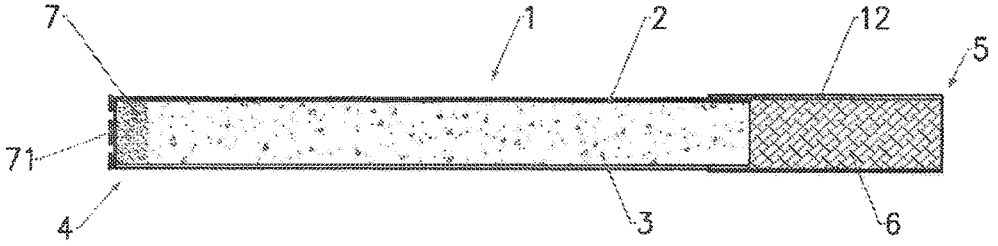

In the example of FIG. 6*c*, a "pad" of tobacco impregnated with primary material 7 is arranged at the end to be lit 4. The end 4 can then be covered with a protection 71 that is cut beforehand from a sheet of absorbent paper in order to retain the "pad" of tobacco and prevent any loss of primary material 7.

The self-lighting device of the invention further comprises a secondary chemical material 8 (or "lighting" material) chosen to be incompatible with the primary chemical material 7. As such, the primary and secondary materials are able to react and to ignite when they are in contact with each other. "Ignite" for the purposes of this invention means to produce a thermal energy (for example from 150° C. to 700° C.), with or without a flame, able to light the cigarette 1. The secondary material 8 can have the form of a liquid, gel, solid, microcapsules, crystals, granules, etc.

The primary material 7/secondary material 8 pair can for example be an oxidant/fuel pair of the type potassium permanganate/glycol; silver nitrate/red phosphorus; silver nitrate/sulphur; chlorates and boric acid/glycols; aluminium/tincture of iodine; sodium metal or other metals of the same family/water or reagents with an alcohol end; Raney nickel or phosphoric materials/oxidants ($MnO_2$, chlorate); nitrocellulose/strong acids (sulphuric, hydrochloric); etc.

Additional substances can be used to dilute, bind, fix, activate or on the contrary slow down or passivate the chemical matter of incompatible bases implemented in the invention. Other substances can furthermore make it possible to reinforce the resistance of the primary 7 and secondary 8 materials in ambient conditions, in particular of humidity (for example water repellents). It is possible to improve the flammability of the tobacco by impregnating the end to be lit 4 with a "sensitising" material such as nitrocellulose, before depositing the primary material 7. This has for advantage to make the lighting reliable while still allowing for the reduction of the primary material 7 to the strict minimum.

The respective quantities of primary 7 and secondary chemical material can vary from 0.1 mg to 5 mg per cigarette.

Preferably, in order to comply with the health standards in effect and prevent any risk of toxicity, the primary material 7 can comprise potassium permanganate and the secondary material 8 can comprise glycerin. Glycerin is a product commonly used as a food additive: it has the form of a viscous liquid that is transparent, colourless, odourless and non-toxic and which has a sweet taste. As for potassium permanganate, this is an inorganic salt commonly used as a disinfectant and as a deodoriser. It is in particular used for treating drinking water.

The chemical reaction initiated by this pair of chemical materials is not instantaneous; a short incubation period of a few seconds is required, without this leading the user to conclude that the cigarette was not lit. The reaction is announced by the prior release of a non-toxic smoke consisting solely of carbon dioxide and water vapour. The reaction is not excessively intense, with the effect being similar to that provoked by the flame of a lighter or of a match. Once the reaction is complete, the end 4 of the cigarette is sufficiently lit to allow time for the smoker to bring the cigarette to his lips and to start breathing in the tobacco smoke ensuring that he does not breathe in the smoke from the incompatibility reaction. These conditions secure the self-lighting of the cigarette 1 and reassure the user. Furthermore, these two chemical materials are sufficiently stable to provide for a duration of use that is sufficient over time.

In order to make available to the user, in a single operation, everything that he needs to light the cigarette as soon as he extracts it from the pack, the secondary material 8 is contained in a receptacle 9.

The receptacle 9 is preferably initially separated from the cigarette 1 and/or from the pack. In this case, the user can have available a plurality of receptacles 9 conditioned in a bag or a specific box. The unitary conditioning of the secondary material 8 makes it possible to limit to a minimum of the quantity of said secondary material used.

In an alternative embodiment, the receptacle 9 can be initially arranged at one of the ends of the cigarette, according to an arrangement that prevents any bringing into contact of said secondary material with the primary material 7. In this case, this receptacle 9 is removable, and configured to be positioned against the end to be lit 4, according to an arrangement allowing for the bringing into contact of the secondary material 8 with the primary material 7. When the user purchases a pack, each cigarette can therefore already be provided with its own receptacle 9, which makes it possible to limit to a minimum the quantity of secondary material used.

Another solution consists in placing a single receptacle or a series of unitary receptacles 9, directly on the cigarette pack, for example on the top of the closing flap.

In practice, the receptacle 9 is configured to fit onto the end to be lit 4. "Fit" in terms of this invention means the possibility that the receptacle 9 has to be positioned on, against and/or around the end to be lit 4, with the possibility of remaining or not fixed to said end.

The receptacle 9 can have a cylindrical, spherical, parallelepiped, or other shape, and be made of paper, cardboard preferably plasticised, of plastic, of rubber, of wadding or "expanded" material of the type used for manufacturing cigarette filters, etc. It can have one or several ends opened towards the exterior or be entirely closed. In practice, the receptacle 9 has the shape of a cylindrical tube, preferably closed at one of its ends 12 and of which the outer diameter corresponds substantially to that of the cigarette 1. The diameter of the receptacle 9 can for example vary from 2 mm to 8 mm. Its length can vary from a few millimeters to a few centimeters.

Figure 5A:
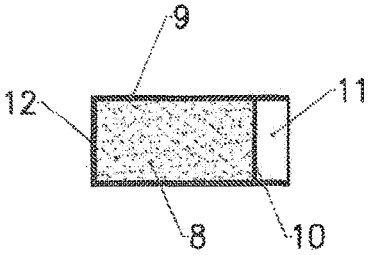
FIGS. 5*a* to 5*c* are longitudinal cross-section views of a receptacle of secondary material in accordance with the invention, in different embodiments, FIGS. 6*a* to 6*c* diagrammatically show different arrangements that can be considered for the primary material on the end to be lit of the cigarette, FIGS. 7*a* to 7*b* diagrammatically show the setting in place of the receptacles of FIGS. 5 to 5*c*, on the end to be lit of the cigarette.
Figure 5B:
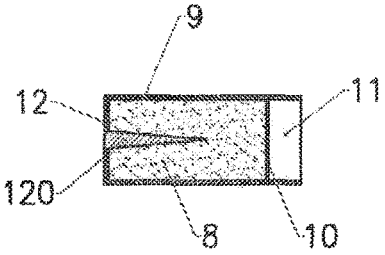

In reference to FIGS. 5*a* to 5*b*, the receptacle 9 comprises a fastening zone 11 configured to fit over the end to be lit 4. This fastening zone 11 has the shape of a cylindrical portion which is opposite the closed end 12 of the tube forming the receptacle 9. A frangible seal 10 forms the bottom of the fastening zone 11, the secondary material 8 being arranged between said seal and the closed end 12. The other end of the fastening zone 11 is open in such a way as to allow for its fitting over the end to be lit 4. The fastening zone 11 has an inner diameter greater than or equal (for example from 0.1 mm to 1 mm) to the outer diameter of the cigarette 1, and a length that can vary from 3 mm to 10 mm.

The secondary material 8 can be directly introduced into the receptacle 9 when it is in solid, gel or cream form. When it is in fluid form, a spongy material of the sponge type can be inserted into the receptacle 9, in such a way as to contain said secondary material 8, a simple pressure on said spongy material making it possible to release said secondary material.

It can also be initially conditioned in one or several capsules, which themselves are arranged later in the receptacle 9. In such a configuration with capsules, the receptacle 9 preferably comprises one or several flexible walls making it possible to break said capsules by crushing when a force of lateral pressure (perpendicular to the axis of the cigarette) or longitudinal pressure (in the axis of the cigarette) is exerted on said flexible wall or walls.

Figure 7A:
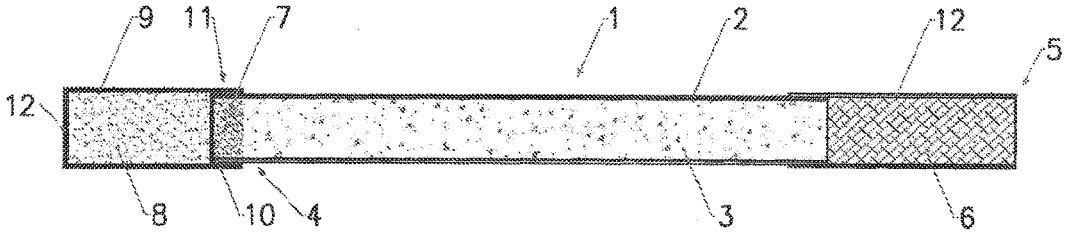

In reference to the embodiment of FIG. 5*a*, and in order to prevent the secondary material 8 from escaping from the receptacle 9, the latter can be closed by a frangible seal 10. In this embodiment, the seal 10 is frangible, made of paper, plastic material, aluminium, etc. In reference to FIG. 7*a*, a simple pressure of the end to be lit 4 on this seal 10 makes it possible to open it and to release the secondary material 8. In practice, as the secondary material 8 is intended to exit the receptacle 9 from the fastening zone 11, the frangible seal 10 is located on this zone.

Figure 7B:
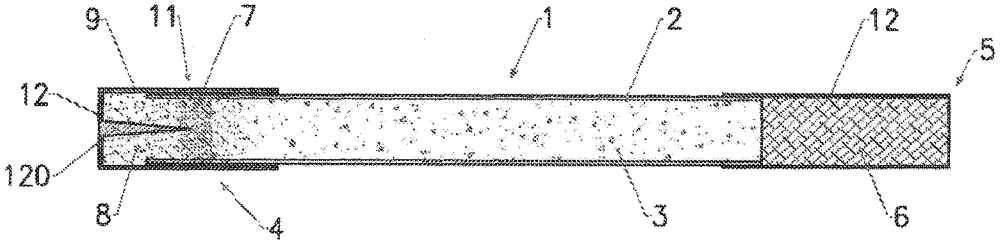

In reference to the embodiment of FIG. 5*b*, a point 120 is arranged inside receptacle 9, on the bottom wall 12, said point being directed towards the fastening zone 11. Following a pressure on the receptacle 9, the point 120 pierces the seal 10 in order to release the secondary material 8 (FIG. 7*b*). The latter then penetrates into the cigarette and ignites the primary material 7.

Figure 5C:
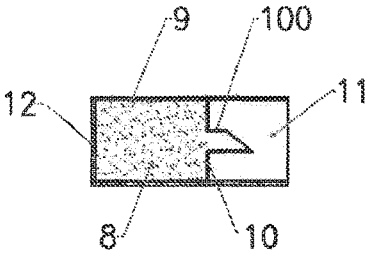

In the embodiment of FIG. 5*c*, the seal 10 is provided with a cannula 100 directed towards the fastening zone 11. The cannula 100 is similar to an injection needle. In reference to FIG. 7*c*, by pressure on the receptacle 9, the secondary material 8 is forced to flow through the cannula 100 and thus penetrates into the cigarette. This solution is particularly advantageous when the primary material 7 is covered with non-treated tobacco. In an alternative of this solution, the seal 10 can slide inside the receptacle 9 then made of rigid material. It is sufficient to insert the cigarette and to press it against the seal 10 in order to slide the latter in a direction that empties the receptacle 9 into the cigarette through the cannula 100.

Other technical solutions can however be considered. The primary material 7 can for example be placed in a small receptacle of which the walls are configured (for example micro-perforated) in order to allow a fluid secondary material 8 to pass through. This solution has the advantage of being able to retain a primary material 7 at the powdery state, without any treatment beforehand that can change its crystalline characteristics.

Likewise, it can be imagined that the primary material 7 be deposited via dusting onto a paper covered with an adhesive whereon the particles of said primary material are glued. The adhesive loaded with particles of primary material 7 is then wound around the end to be lit 4 of the cigarette 1.

The cigarette paper itself can also incorporate an adhesive strip on the side of the end to be lit 4 of the cigarette 1: the paper is loaded beforehand with particles of primary material 7 and used as such before loading with tobacco of the cigarette 1.

FIGS. 1 to 4 show how a smoker can light a cigarette with simple gestures, whether he is holding said cigarette in a hand or brings it not yet lit to his mouth.

Figure 2:
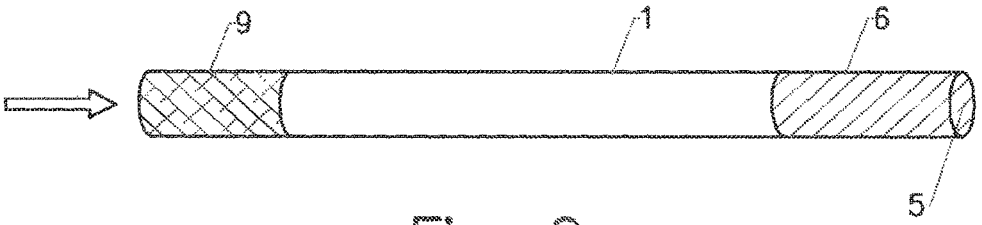
Figure 3:
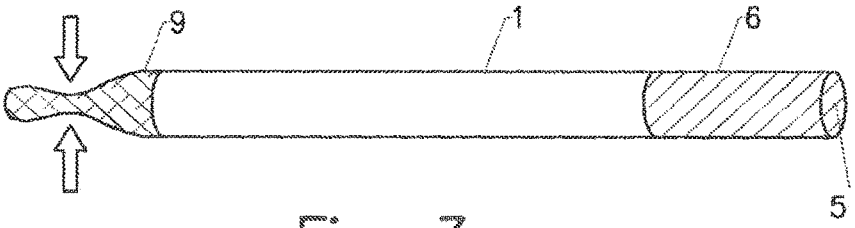
Figure 4:
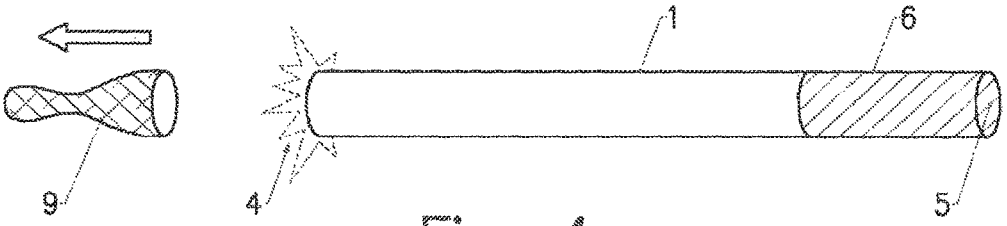
Figure 7C:
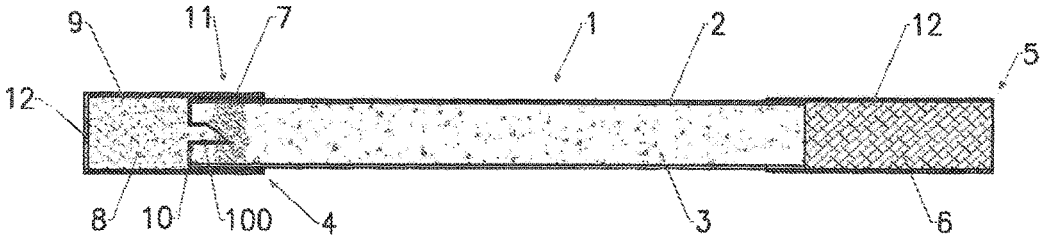

The user takes the receptacle 9 (FIG. 1) and positions it facing the end to be lit 4. The receptacle 9 is then brought into contact with the end to be lit 4 in such a way that the secondary material 8 wets the primary material of which the end to be lit 4 is coated (FIG. 2). When the receptacle 9 is closed, the user can bring the secondary material 8 into contact with the primary material 7 by crushing said receptacle (FIG. 3). When the receptacle 9 is closed by a seal 10, the user can bring the secondary material 8 into contact with the primary material 7 by piercing said seal by means of the end to be lit 4 (FIG. 7*a*), or piercing said seal by means of the point 120 (FIG. 7*b*) or directly by means of the cannula 100 (FIG. 7*c*). When the receptacle 9 is opened towards the exterior, the user can bring the secondary material 8 into contact with the primary material 7 by directly inserting the end to be lit 4 of the cigarette 1 inside said receptacle. Once the secondary material 8 is in contact with the primary material 7, the user removes the receptacle 9 from the end to be lit 4 (FIG. 4). The reaction is initiated and the end to be lit 4 is ignited.

The invention claimed is:

1. A self-lighting device for a cigarette comprising:

a primary chemical material to be placed at an end to be lit of the cigarette, a secondary chemical material that is incompatible with the primary material, said primary and secondary materials being capable of igniting when they are in contact with each other, said secondary material being arranged in a receptacle configured to fit over the end to be lit of the cigarette and bring into contact said secondary material with said primary material, said receptacle being closed at one of its ends, the receptacle comprises a fastening zone having the shape of a cylindrical portion configured to fit over the end to be lit of a cigarette, wherein a seal forms the bottom of the fastening zone, with the secondary material being arranged between said seal and the closed end of the receptacle, said seal being provided with a cannula directed towards said fastening zone, and configured so that said secondary material can flow outside of said cannula when a pressure is exerted on said receptacle.

2. A device according to claim 1, wherein the receptacle has a shape of a cylindrical tube of which the outer diameter corresponds substantially to that of a cigarette.

3. A device according to claim 1, wherein the primary chemical material comprises potassium permanganate and the secondary chemical material comprises glycerin.

4. A device according to claim 1, wherein the secondary material has a solid, gel or cream form, said material being directly introduced into the receptacle.

5. A device according to claim 1, wherein the cannula is similar to an injection needle.

6. A device according to claim 1, wherein the fastening zone has an inner diameter greater or equal to the outer diameter of the cigarette, and a length that varies from 3 mm to 10 mm.

7. A device according to claim 1, wherein the primary material, liquid or solid, is encapsulated.

* * * * *